US012337439B2

(12) United States Patent
Gurusamy et al.

(10) Patent No.: US 12,337,439 B2
(45) Date of Patent: Jun. 24, 2025

(54) MULTIPLE DISK PAD CONDITIONER

(71) Applicant: Applied Materials, Inc., Santa Clara, CA (US)

(72) Inventors: Jay Gurusamy, Santa Clara, CA (US); Steven M. Zuniga, Soquel, CA (US); Takashi Fujikawa, Sunnyvale, CA (US); Jeonghoon Oh, Saratoga, CA (US)

(73) Assignee: Applied Materials, Inc., Santa Clara, CA (US)

( * ) Notice: Subject to any disclaimer, the term of this patent is extended or adjusted under 35 U.S.C. 154(b) by 243 days.

(21) Appl. No.: 17/888,007

(22) Filed: Aug. 15, 2022

(65) Prior Publication Data

US 2024/0051081 A1 Feb. 15, 2024

(51) Int. Cl.
*B24B 37/20* (2012.01)

(52) U.S. Cl.
CPC ..... *B24B 37/20* (2013.01)

(58) Field of Classification Search
CPC .... B24B 1/00; B24B 5/00; B24B 7/16; B24B 7/00; B24B 33/00; B24B 37/04; B24B 37/20; B24B 37/30; B24B 37/345; B24B 37/042; B24B 53/017; B24B 53/02; B24B 53/14; B24B 7/228; B24B 27/0023; B24B 27/0069; B24B 27/0076; B24B 37/005; B24B 49/16; B24B 49/18; B24B 53/003; B24B 53/005; B24B 53/053; B24B 53/08; B24B 53/12; B24B 451/08–11; B24B 451/41; B24B 451/56; B24B 451/285; B24B 451/287; B24B 451/288;
(Continued)

(56) References Cited

U.S. PATENT DOCUMENTS 7,544,113 B1 6/2009 Benner
9,308,623 B2 * 4/2016 Chen ..... B24B 53/017
(Continued)

FOREIGN PATENT DOCUMENTS

CN 109807749 A 5/2019
CN 111571444 A 8/2020
(Continued)

OTHER PUBLICATIONS

CN_111571444 English Translation (Year: 2020).*
(Continued)

*Primary Examiner* — Monica S Carter
*Assistant Examiner* — Sharonda T Felton
(74) *Attorney, Agent, or Firm* — Patterson + Sheridan, LLP

(57) ABSTRACT

Embodiments of the present disclosure provide a multiple disk pad conditioner and methods of using the multiple disk pad conditioner during a chemical mechanical polishing (CMP) process. The multiple disk pad conditioner has a plurality of conditioning heads having conditioning disks affixed thereto. The multiple disk pad conditioner can include a conditioning arm, and a plurality of conditioning heads attached to the conditioning arm. Each of the plurality of conditioning heads has a conditioning disk affixed thereto. In some embodiments, each of the conditioning heads include a rotational axis, wherein each of the rotational axes is disposed a distance apart in a first direction that extends along the length of the conditioning arm.

20 Claims, 12 Drawing Sheets

(58) Field of Classification Search
CPC ..... B24B 451/333; B24B 451/335; B24B 451/337; B24B 451/443
USPC ..... 451/285, 443, 540, 56, 444
See application file for complete search history.

(56) References Cited

U.S. PATENT DOCUMENTS

| | | | | |
|---|---|---|---|---|
| 10,052,741 | B2 | 8/2018 | Watanabe et al. | |
| 10,857,651 | B2 * | 12/2020 | Lan | B24B 53/017 |
| 2002/0037681 | A1 | 3/2002 | Gitis et al. | |
| 2005/0113009 | A1 | 5/2005 | Lee et al. | |
| 2010/0105302 | A1 | 4/2010 | Chen et al. | |
| 2010/0291840 | A1 * | 11/2010 | Huang | B24B 53/017 451/72 |
| 2015/0174726 | A1 * | 6/2015 | Litke | C08G 18/10 451/526 |
| 2019/0283209 | A1 | 9/2019 | Osterheld et al. | |
| 2020/0269384 | A1 | 8/2020 | Chen et al. | |
| 2021/0323117 | A1 | 10/2021 | Rangarajan et al. | |

FOREIGN PATENT DOCUMENTS

| | | | |
|---|---|---|---|
| EP | 1459847 | A2 | 9/2004 |
| JP | 2002-511345 | A | 4/2002 |
| JP | 2003145424 | A | 5/2003 |
| JP | 2008246654 | A | 10/2008 |
| JP | 2021517519 | A | 7/2021 |
| KR | 10-2020-0120960 | A | 10/2020 |
| TW | 200427547 | A | 12/2004 |
| TW | 200721291 | A | 6/2007 |
| TW | 200726570 | A | 7/2007 |
| TW | 200819243 | A | 5/2008 |
| TW | I393182 | B | 4/2013 |
| TW | I672759 | B | 9/2019 |
| TW | 201938321 | A | 10/2019 |
| TW | 202124098 | A | 7/2021 |
| TW | I737928 | B | 9/2021 |
| TW | 202210234 | A | 3/2022 |
| TW | 202216362 | A | 5/2022 |
| WO | 03002300 | A1 | 1/2003 |
| WO | 2018063242 | A1 | 4/2018 |
| WO | 02076674 | A2 | 10/2022 |

OTHER PUBLICATIONS

Chinese Office Action issued to Patent Application No. 202320136891.8 on Apr. 26, 2023.
International Search Report issued to PCT/US2022/080346 on May 9, 2023.
Taiwan Office Action issued to Patent Application No. 111148204 on Jan. 30, 2024.
Taiwan Office Action issued to Patent Application No. 111148204 on Oct. 12, 2023.
Korean Office Action dated Jan. 22, 2025 re: Korean Application No. 10-2023-7001937.
Notice for Reasons for Rejection dated re: Nov. 5, 2024; re: Japanese Patent Application No. 2023-504000.
Taiwanese Office Action dated Jan. 9, 2025 re Taiwanese Patent Application No. 111148204.
European Search Report dated Nov. 13, 2024 regarding European Application No. 22817860.4.

* cited by examiner

MULTIPLE DISK PAD CONDITIONER

FIELD OF DISCLOSURE

The present disclosure relates to chemical mechanical polishing (CMP), and more specifically to a multiple disk pad conditioner for use in chemical mechanical polishing.

BACKGROUND OF DISCLOSURE

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively less planar. This non-planar outer surface presents a problem for the integrated circuit manufacturer as a non-planar surface can prevent proper focusing of the photolithography apparatus. Therefore, there is a need to periodically planarize the substrate surface to provide a planar surface.

CMP is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, a polishing liquid, typically including an abrasive and at least one chemically reactive agent, may be spread on the polishing pad.

When the polisher is in operation, the pad is subject to compression, shear and friction producing heat and wear. Slurry and abraded material from the wafer and pad are pressed into the pores of the pad material and the material itself becomes matted and even partially fused. These effects, sometimes referred to as "glazing," reduce the pad's roughness and ability to apply and retain fresh slurry on the pad surface. It is, therefore, desirable to condition the pad by removing trapped slurry, and unmatting, re-expanding or re-roughening the pad material. The pad can be conditioned after each substrate is polished, or after a number of substrates are polished, which is often referred to as ex-situ pad conditioning. The pad can also be conditioned at the same time substrate are polished, which is often referred to as in-situ pad conditioning.

Therefore, there is a need for a method and device that can reliably and uniformly condition a polishing pad. There is also a need for a method and device that solves the problems described above.

SUMMARY

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limiting the scope of the claimed subject matter.

An aspect of the present disclosure provides a multiple disk pad conditioner for conditioning a polishing pad, comprising a conditioning arm; and a plurality of conditioning heads attached to the conditioning arm, wherein each of the plurality of conditioning heads has a conditioning disk affixed thereto, each of the plurality of conditioning heads comprise a rotational axis, and each of the rotational axes are is disposed a distance apart in a first direction that extends along the length of the conditioning arm.

Another aspect of the present disclosure provides a method of conditioning a polishing pad, conditioning the polishing pad using a multiple disk pad conditioner, wherein the multiple disk pad conditioner comprises: a conditioning arm for carrying a plurality of pad conditioning heads; each of the plurality of conditioning heads has a conditioning disk affixed thereto; each of the plurality of conditioning heads comprise a rotational axis; and each of the rotational axes are is disposed a distance apart in a first direction that extends along the length of the conditioning arm, and conditioning the polishing pad comprises urging the plurality of pad conditioning heads against a surface of a polishing pad.

Yet another aspect of the present disclosure provides a polishing system, comprising: a plurality of polishing modules, each comprising: a carrier support module comprising a carrier platform, and one or more carrier assemblies comprising one or more corresponding carrier heads which are suspended from the carrier platform; a carrier loading station for transferring substrates to and from the one or more carrier heads; a polishing station comprising a polishing platen, wherein the carrier support module is positioned to move the one or more carrier assemblies between a substrate polishing position disposed above the polishing platen and a substrate transfer position disposed above the carrier loading station; and a multiple disk pad conditioner having a plurality of conditioning heads attached to the conditioning assembly and disposed linearly along the conditioning assembly; and wherein each of the plurality of conditioning heads has a conditioning disk affixed thereto.

One or more of the following possible advantages may be realized. The multiple disk pad conditioner can reduce time for pad conditioning. The multiple disk pad conditioner provides additional and/or more efficient conditioning to occur as multiple conditioning surfaces may concurrently contact the polishing pad surface. Thus, conditioning process time may be reduced, and the useful life of the conditioning elements may be extended in comparison to conventional pad conditioners.

The details of one or more implementations are set forth in the accompanying drawings and the description below. Other aspects, features, and advantages will be apparent from the description and drawings, and from the claims.

BRIEF DESCRIPTION OF THE FIGURES

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and:

FIG. 4A shows the multiple disk pad conditioner in a conditioning position and FIG. 4B shows the multiple disk pad conditioner in a cleaning position;

FIG. 6A shows the multiple disk pad conditioner in a conditioning position and FIG. 6B shows the multiple disk pad conditioner in a cleaning position;

DETAILED DESCRIPTION

Figure 1:
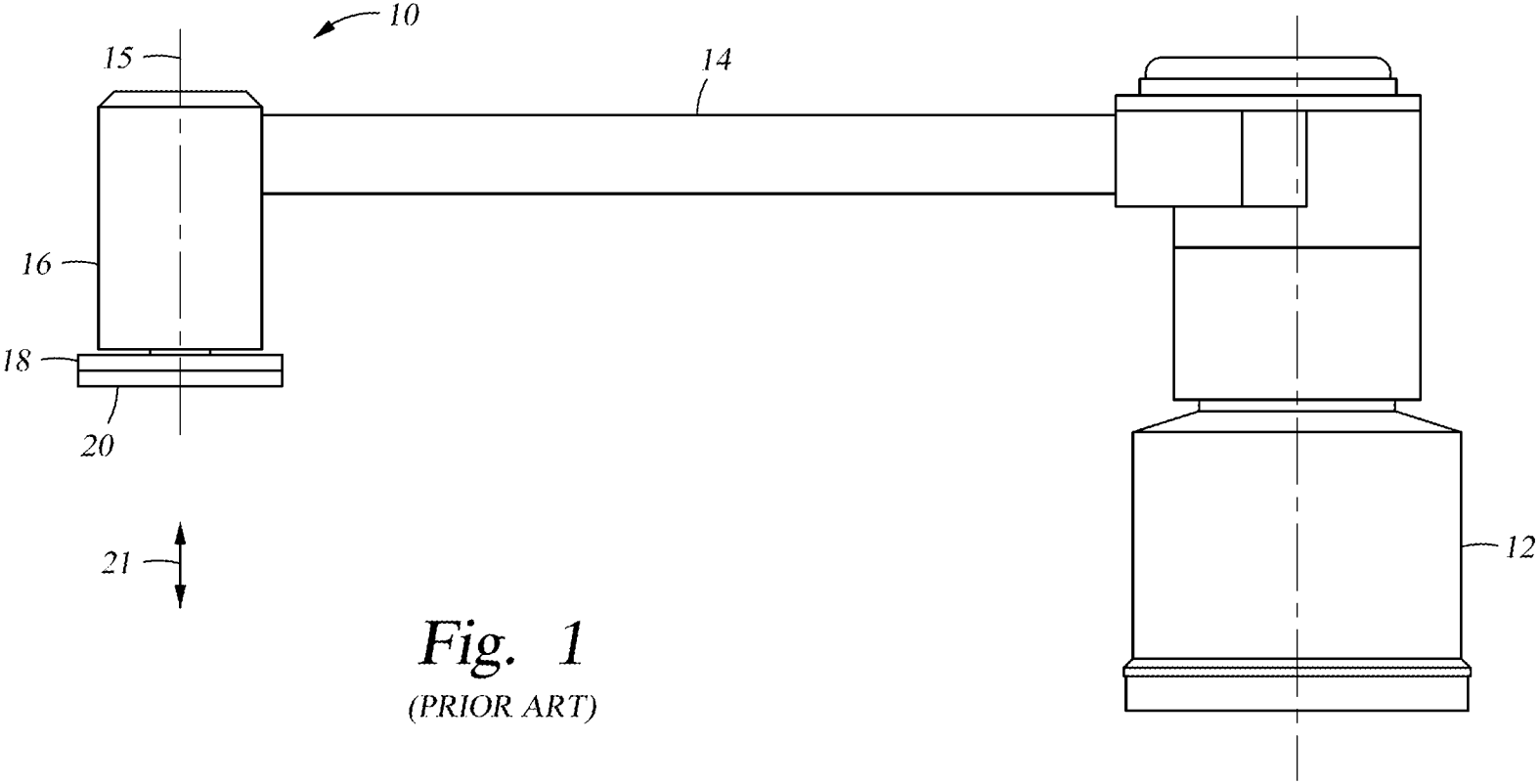
Fig. 1 (PRIOR ART)
FIG. 1 illustrates a side view of a pad conditioning assembly according to the prior art.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements.

Embodiments of the present disclosure provide CMP processes that include an in-situ pad conditioning step in which a conditioning disk, e.g., a disk coated with abrasive diamond particles, is pressed against the rotating polishing pad to condition and texture the polishing pad surface concurrent with substrate polishing. It should be understood, however, that embodiments of the present disclosure also allow for ex-situ conditioning of the polishing pad.

FIG. 1 illustrates a known pad conditioning assembly 10 in accordance with the prior art. Pad conditioning assembly 10 may include a base 12, an arm 14, a conditioning head 16, and a pad conditioner 18 mounted to conditioning head 16. Pad conditioner 18 may have a conditioning surface 20 with abrasive particles thereon. Conditioning surface 20 may be configured to rub against and abrade a surface of a polishing pad. Conditioning head 16 may be configured to vertically move pad conditioner 18 (as indicated by arrow 21) from an elevated retracted position (as shown in FIG. 1) to a lowered extended position such that conditioning surface 20 of pad conditioner 18 may engage a polishing surface of a polishing pad (not shown). Conditioning head 16 may further be configured to rotate pad conditioner 18 about longitudinal axis 15. Arm 14 may be configured to rotate about longitudinal axis 15 such that conditioning head 16 may sweep across a polishing pad surface (not shown) with a reciprocal motion. The rotating motion of pad conditioner 18 and the reciprocating motion of conditioning head 16 may cause conditioning surface 20 of pad conditioner 18 to condition the polishing surface of the polishing pad by abrading the polishing surface to remove contaminants and to retexture the surface.

In embodiments of the present disclosure, a multiple disk pad conditioner is provided that can reduce time for pad conditioning. The multiple disk pad conditioner provides additional pad coverage and/or more efficient conditioning to occur as multiple conditioning surfaces may concurrently contact and abrade the polishing pad surface during a pad conditioning process. Thus, conditioning process times may be reduced, and the useful life of the conditioning elements may be extended in comparison to conventional pad conditioners utilizing a single conditioning surface.

Figure 2A:
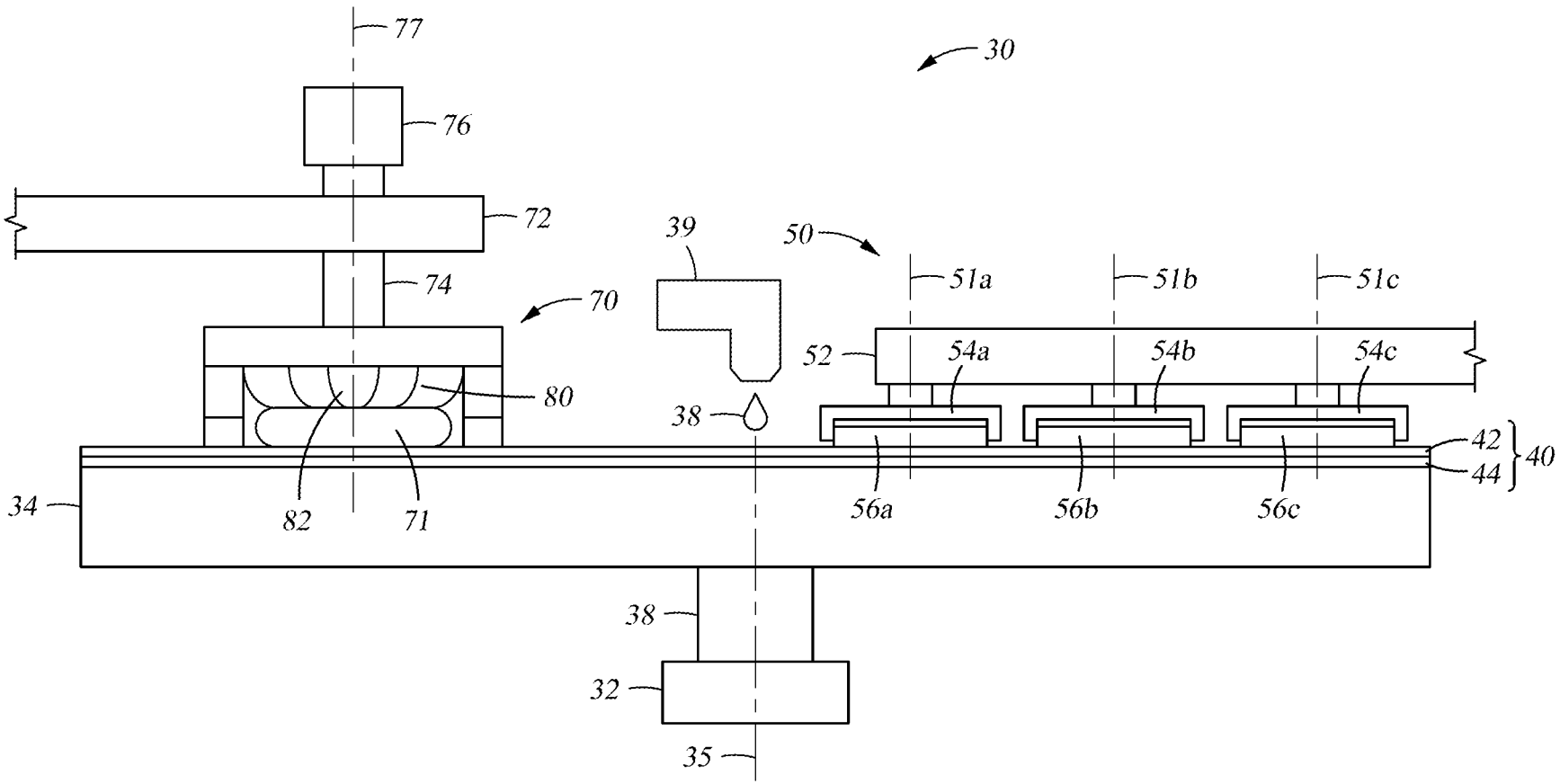
FIG. 2A is a schematic cross-sectional side view of a polishing station having a multiple disk pad conditioner of the present disclosure.
Figure 2B:
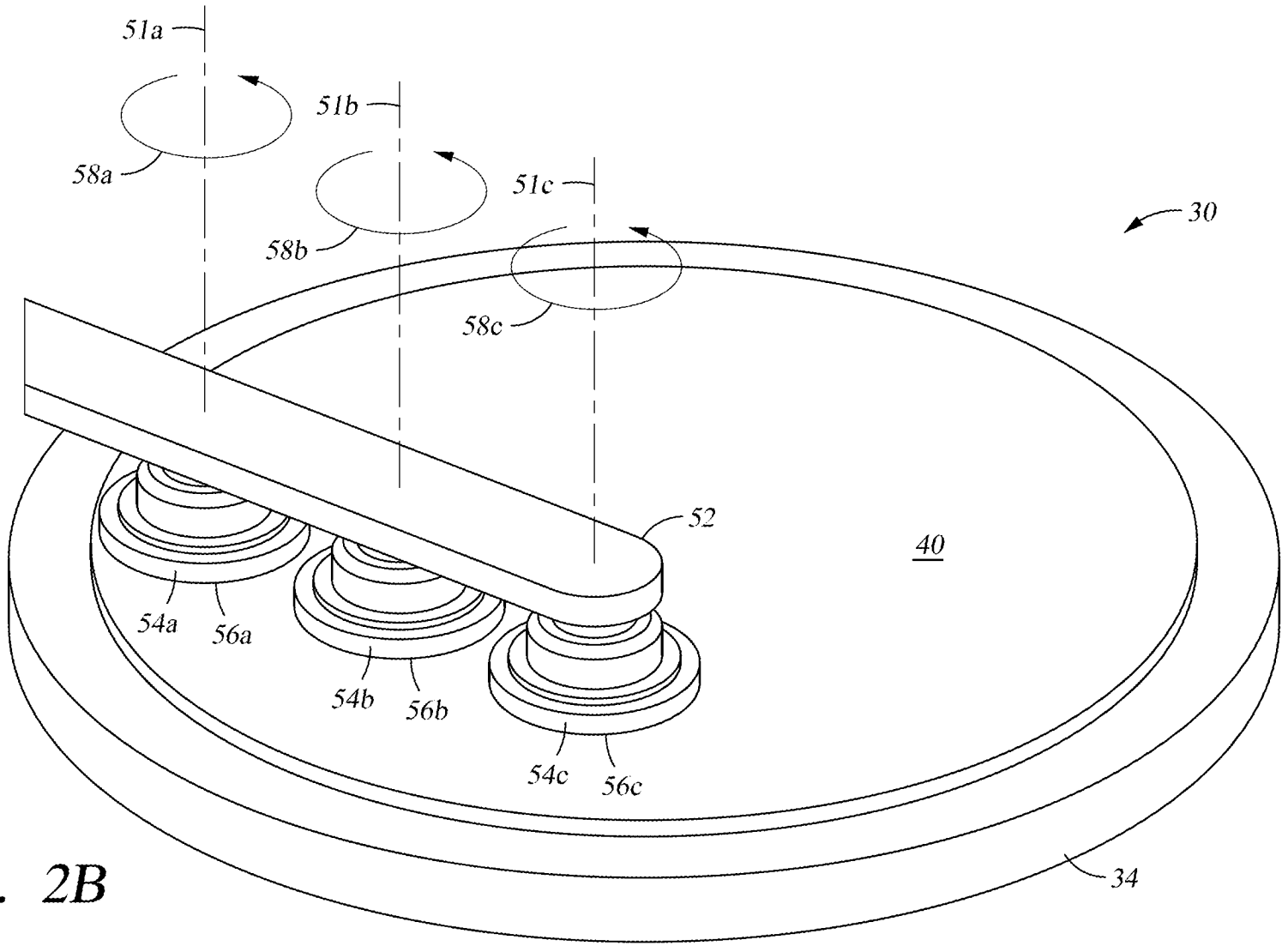
FIG. 2B is a schematic perspective view of the multiple disk pad conditioner of the present disclosure placed on a polishing pad for conditioning the polishing pad.

An embodiment of the multiple disk pad condition of the present disclosure is illustrated in FIGS. 2A and 2B. Specifically, FIG. 2A provides a side view schematic cross-sectional side view of a the multiple disk pad conditioner 50 within a polishing station 30, and FIG. 2B provides a schematic perspective view of the multiple disk pad conditioner 50 of the present disclosure placed on a polishing pad 40 for conditioning the polishing pad.

As shown in FIGS. 2A and 2B, the polishing station 30 of a CMP apparatus includes a rotatable disk-shaped platen 34, which supports a polishing pad 40, and a carrier head 70 to hold a substrate 71 against the polishing pad 40. As discussed herein, the CMP apparatus can include multiple polishing stations.

In embodiments of the present disclosure, the polishing pad 40 can be a two-layer polishing pad with an outer layer 44 and a softer backing layer 42. In some cases, the polishing pad 40 can be a soft polishing pad or a 3D printed polishing pad. That is, the construction materials of the polishing pad 40 can include soft materials or 3D printing materials, which can include polymeric materials. The polishing pad can have a hardness of 40 to 80 Shore D scale.

The platen 34 is operable to rotate about an axis 35. For example, a motor 32 can turn a drive shaft 38 to rotate the platen 34 and polishing pad 40.

The carrier head 70 is suspended from a support structure 72, e.g., a carousel or a track, and is connected by a drive shaft 74 to a carrier head rotation motor 76 so that the carrier head can rotate about an axis 77. Optionally, the carrier head 70 can oscillate laterally, e.g., on sliders on the carousel or track 72; or by rotational oscillation of the carousel itself. In operation, the platen is rotated about its central axis 35, and the carrier head is rotated about its central axis 77 and translated laterally across the top surface of the polishing pad 40. Where there are multiple carrier heads, each carrier head 70 can have independent control of its polishing parameters, for example each carrier head 70 can independently control the pressure applied to each respective substrate 71.

The carrier head 70 can include a flexible membrane 80 having a substrate mounting surface to contact the back side of the substrate 71, and a plurality of pressurizable chambers 82 to apply different pressures to different zones, e.g., different radial zones, on the substrate 71. The carrier head 70 can also include a retaining ring to hold the substrate.

The polishing station 30 can include a supply port or a combined supply-rinse arm 39 to dispense a polishing liquid 38, such as slurry, onto the polishing pad 40

The polishing station 30 also includes an embodiment of the multiple disk pad conditioner 50 of the present disclosure. In one embodiment, the multiple disk pad conditioner 50 of the present disclosure comprises a plurality of conditioning heads linearly arranged. In the example illustrated in FIGS. 2A and 2B, the multiple disk pad conditioner 50 includes three conditioning heads 54*a*, 54*b*, and 54*c*, but it should be understood that any number of conditioning heads may be utilized dependent on the specifications for a particular conditioning application. It should also be understood that although the conditioning heads 54*a*, 54*b*, and 54*c* are shown having substantially equal spacing along the conditioning arm 52 of the multiple disk pad conditioner 50, the spacing of the conditioning heads 54*a*, 54*b*, 54*c* can be set at any spacing useful for the particular conditioning process. As shown, in addition to the conditioning heads 54*a*, 54*b*, and 54*c*, the multiple pad conditioner 50 of the present disclosure comprises base 53 (FIGS. 4A-7B) and a conditioning arm 52 connecting the conditioning heads 54*a*, 54*b*, and 54*c* to the base. The base 53 can include an actuator 59 that is configured to rotate a portion of the arm 52 about an arm axis 52A (FIG. 7A). The base 53 is thus configured to cause the arm 52 and the conditioning heads 54*a*, 54*b*, and 54*c* to sweep across a surface of the polishing pad 40.

The polishing station 30 can also include a cleaning station 90 (shown in FIGS. 4A and 4B), which contains a one or more nozzles that configured to deliver a cleaning and/or rinsing liquid to the conditioning heads 54*a*, 54*b*, and 54*c*. The cleaning station 90 may also include one or more brushes of abrasive disks that are configured to engage with the conditioning surface of each of the conditioning heads 54*a*, 54*b*, and 54*c*. The conditioning arm 52 and base 53 can move the conditioning heads 54*a*, 54*b*, and 54*c* out of the cleaning station 90 and place the conditioning heads 54*a*, 54*b*, and 54*c* atop the polishing pad 40. In some embodiments, the cleaning station 90 is configured to simultaneously process the conditioning heads 54*a*, 54*b*, and 54*c*, and thus is shaped to match the configuration of the conditioning heads 54*a*, 54*b*, and 54*c*, such as the configurations illustrated in FIGS. 4A-4B and 6A-6B.

The conditioning heads 54*a*, 54*b*, and 54*c* comprise conditioning disks 56*a*, 56*b*, and 56*c* that can be simultaneously brought into contact with the polishing pad 40. In some embodiments, as discussed below, it is desirable to simultaneously bring less than the complete number of conditioning disks into contact with the polishing pad 40 during at least a portion of a pad conditioning recipe. The conditioning disks 56*a*, 56*b*, and 56*c* are generally positioned at a bottom of the conditioning heads 54*a*, 54*b*, and 54*c* and can rotate around a respective axis 51*a*, 51*b*, and 51*c*. In some embodiments, as shown in FIGS. 2A and 2B, each of the rotational axes axis 51*a*, 51*b*, and 51*c* are disposed a distance apart in a first direction that extends along the length of the conditioning arm 52, wherein the length is generally defined by the distance between the arm axis 52A (FIG. 7A) and the opposing distal end of the conditioning arm 52. A bottom surface of the conditioning disks 56*a*, 56*b*, and 56*c*, include abrasive regions that contact the surface of the polishing pad 40 during the conditioning process. During conditioning, both the polishing pad 40 and the conditioning disks 56*a*, 56*b*, and 56*c* may rotate, so that these abrasive regions move relative to the surface of the polishing pad 40, thereby abrading and retexturizing the surface of the polishing pad 40.

The conditioning heads 54*a*, 54*b*, and 54*c* include mechanisms to attach the conditioning disks 56*a*, 56*b*, and 56*c* to the conditioning heads 54*a*, 54*b*, and 54*c* (such as mechanical attachment systems, e.g., bolts or screws, or magnetic attachment systems) and mechanisms to rotate the conditioning disks 56*a*, 56*b*, and 56*c* around the respective rotating axis 51*a*, 51*b*, and 51*c* (such as drive belts through the arm or rotors inside the conditioner head). In embodiments of the present disclosure the conditioning heads 54*a*, 54*b*, and 54*c* and the conditioning disks 56*a*, 56*b*, and 56*c* are driven by a single motor to cause each conditioning head 54*a*, 54*b*, and 54*c* rotate at the same revolutions-per-minute (RPM). In one example, the each conditioning head 54*a*, 54*b*, and 54*c* is rotate at substantially the same RPM, or similar RPM (+/−20%), as the RPM of the polishing platen. In alternate embodiments, the conditioning disks 56*a*, 56*b*, and 56*c* may be rotated at different RPMs through use of differing motors, different gearing, or other rotational control mechanisms known in the art.

In some embodiments, due to the variation in linear speed of a rotating polishing pad 40 with the radius of the rotating pad (i.e., velocity (v)=ω·r, where w is the angular speed (rad/s) and r is the radius (mm) of the platen), it is desirable to adjust the rotational speed of each of the conditioning disks 56*a*, 56*b*, and 56*c* relative to their radial position on the polishing pad as the arm 52 is swept across the polishing pad. In one example, when the arm 52 is aligned with the radius of the platen 34 (e.g., solid lined multiple disk pad conditioner 50 in FIG. 5) the conditioning head 54*c* is rotated at angular speed that is greater than the angular speed of the conditioning head 54*b*, which has an angular speed that is greater than the angular speed of the conditioning head 54*a*. In another example, when the arm 52 is aligned in a tangential relationship to a radius of the platen 34 (e.g., dashed multiple disk pad conditioner 50 in FIG. 5), the conditioning head 54*c* can be rotated at an angular speed that is similar to the angular speeds of the conditioning head 54*b* and the conditioning head 54*a*, since the linear speeds of the pad experienced by each of conditioning heads will be similar. In embodiments of the present disclosure the conditioning heads 54*a*, 54*b*, and 54*c* and polishing pad 40 (i.e., platen) are both driven at a varying RPM during a pad conditioning process. In one processing configuration, the conditioning heads 54*a*, 54*b*, and 54*c* and polishing pad 40 are driven at substantially the same RPM, or similar RPM (+/−20%), at each instant in time during the pad conditioning process.

In addition, the multiple disk pad conditioner 50 can also include mechanisms to regulate the pressure (i.e., down force) between the conditioning disks 56*a*, 56*b*, and 56*c* and the polishing pad 40 (such as pneumatic or mechanical actuators inside the conditioning heads or the base). For example, the conditioning disks 54*a*, 54*b*, and 54*c* can each include a down-force actuator to adjust the pressure of the conditioning disks 56*a*, 56*b*, and 56*c* on the polishing pad 50. In embodiments of the present disclosure, the down-force actuator may include a single electronic pressure regulator (EPR) that is disposed within the base 53 and used to uniformly control the pressure of all of the conditioning disks 56*a*, 56*b*, and 56*c*. In alternate embodiments of the present disclosure, the pressure of the conditioning disks 56*a*, 56*b*, and 56*c* may be regulated independently by use of a down-force actuator that includes a force generating device for better control. Such pressure control mechanisms are known and can have many possible implementations in embodiments of the present disclosure, and can include, for example, air cylinders, bladders, solenoids or other similar devices. In one embodiment, the pressure applied to each of the conditioning disks 54*a*, 54*b*, and 54*c* is adjusted such that one or more of the conditioning disks 54*a*, 54*b*, and 54*c* is placed in contact with the polishing pad 40. The down-force actuator, or down-force actuators, used to regulate the pressure between the conditioning disks 56*a*, 56*b*, and 56*c* and the polishing pad 40 is thus also configured to retract one or more of the conditioning disks 56*a*, 56*b*, and 56*c* from the surface of polishing pad and/or simultaneously generate a positive pressure between one or more other of the conditioning disks 56*a*, 56*b*, and 56*c* and the polishing pad 40 during processing.

In embodiments of the present disclosure, the conditioning disks 56*a*, 56*b*, and 56*c* of the multiple disk pad conditioner 50 include abrasive elements, such as abrasive diamond particles secured to the conditioning disks 56*a*, 56*b*, and 56*c*. It is understood that in some embodiments other compositions such as silicon carbide can be used instead of or in addition to the abrasive diamond particles. The abrasive diamond particles provide a structure capable of removing (e.g., cutting, polishing, scraping) material from the polishing pad 40. Each individual abrasive diamond particle can have one or more cutting points, ridges or mesas. In some implementations, the abrasive diamond particles are substantially rectangular solid in shape. Such "blocky" abrasive particles can provide superior conditioning of the material used in 3D printed polishing pads, e.g., a low wear rate while maintaining uniform surface roughness across the pad, as compared to other shapes such as jagged, octahedral, etc. In some implementations, the abrasive diamond particles are 125-250 μm in size. In some implementations, the diamond abrasive particles have a mean diameter of 140-200 μm, e.g., 150-180 μm, and a standard deviation less than 40 μm, e.g., less than 30 μm, e.g., less than 20 μm, e.g., less than 10 μm. This size range can provide superior conditioning of the material used in 3D printed polishing pads, e.g., a low wear rate while maintaining uniform surface roughness across the pad.

Figure 3:
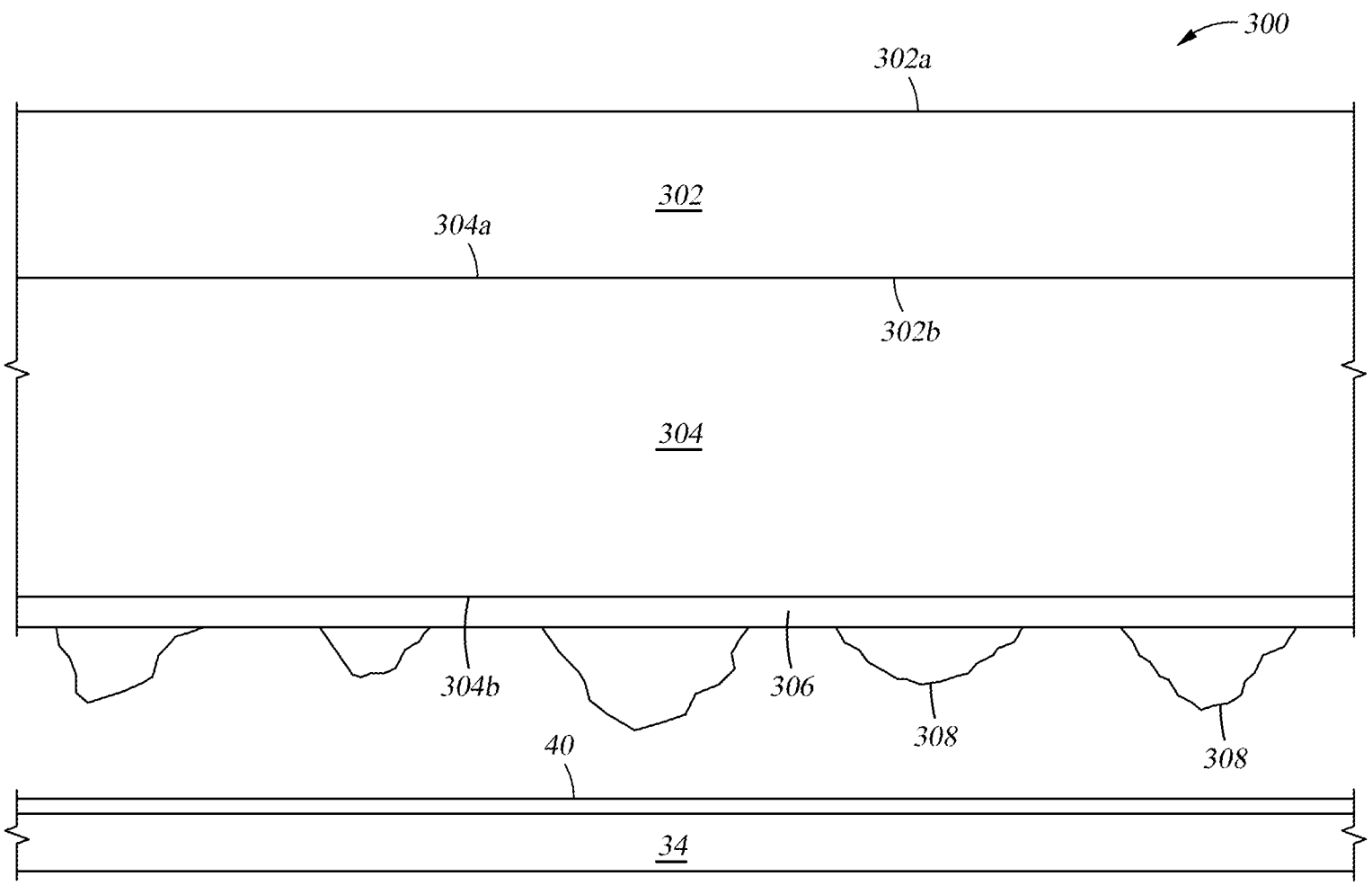
FIG. 3 is a side view of a multi-layer disk used in an embodiment of the present disclosure.

In another embodiment of the present disclosure, each of the conditioning disks 56*a*, 56*b*, and 56*c* comprise a multi-layer diamond disk. FIG. 3 provides a side view of an embodiment of the multi-layer diamond disk 300. As shown, each multi-layer diamond disk 300 includes a support plate 302 in the form of a generally planar disk. The support plate 302 has an upper surface 302*a* that can contact the conditioning disks 54*a*, 54*b*, and 54*c* and a lower surface 302*b*. The support plate 302 can be a durable rigid material, e.g., a metal, such as stainless steel, or a ceramic.

Affixed to the lower surface 302*b* of the support plate 302 is a flexible member 304 comprised of a rubber, elastomer, silicone, or the like. The upper surface 304*a* of the flexible member 304 is affixed to the lower surface 302*b* of the support plate 302. The lower surface 304*b* of the flexible member 304 is affixed to a flexible backing element 306, comprised of flexible material such as an elastomeric material. In one example, the flexible backing element 306 includes a rubber or silicone material. In one embodiment, the flexible backing element 306 includes a thin metal plate (e.g., SST or aluminum (Al) foil or plate) or the like. The flexible backing element 306 is to be deformable under the loads applied by the down-force actuator configured to apply a downforce to the multilayer diamond disk 300 and pad 40 during a pad conditioning process.

In this embodiment, the abrasive diamond particles 308 can be fixed to the flexible backing element 306 by a variety of techniques. For example, the abrasive diamond particles 308 can be attached to the flexible backing element 306 by way of known electroplating and/or electrodeposition processes. As another example, the abrasive diamond particles 308 can be attached to the flexible backing element 306 by way of organic binding, brazing or welding processes.

The multi-layer disk 300 in this embodiment of the present disclosure provides for better contact between the abrasive diamond particles 308 and the polishing pad 306. The flexibility provided by the flexible member 304 and the flexible backing element 306 enables the abrasive diamond particles 308 to remain in substantially constant contact with the polishing pad 40 even for those abrasive diamond particles 308 that have ground down through normal wear and tear from the conditioning process. The flexible member 304 and flexible backing element 308 flex to maintain constant contact between the individual abrasive diamond particles 308 as pressure is applied to the support plate 302.

Figure 4A:
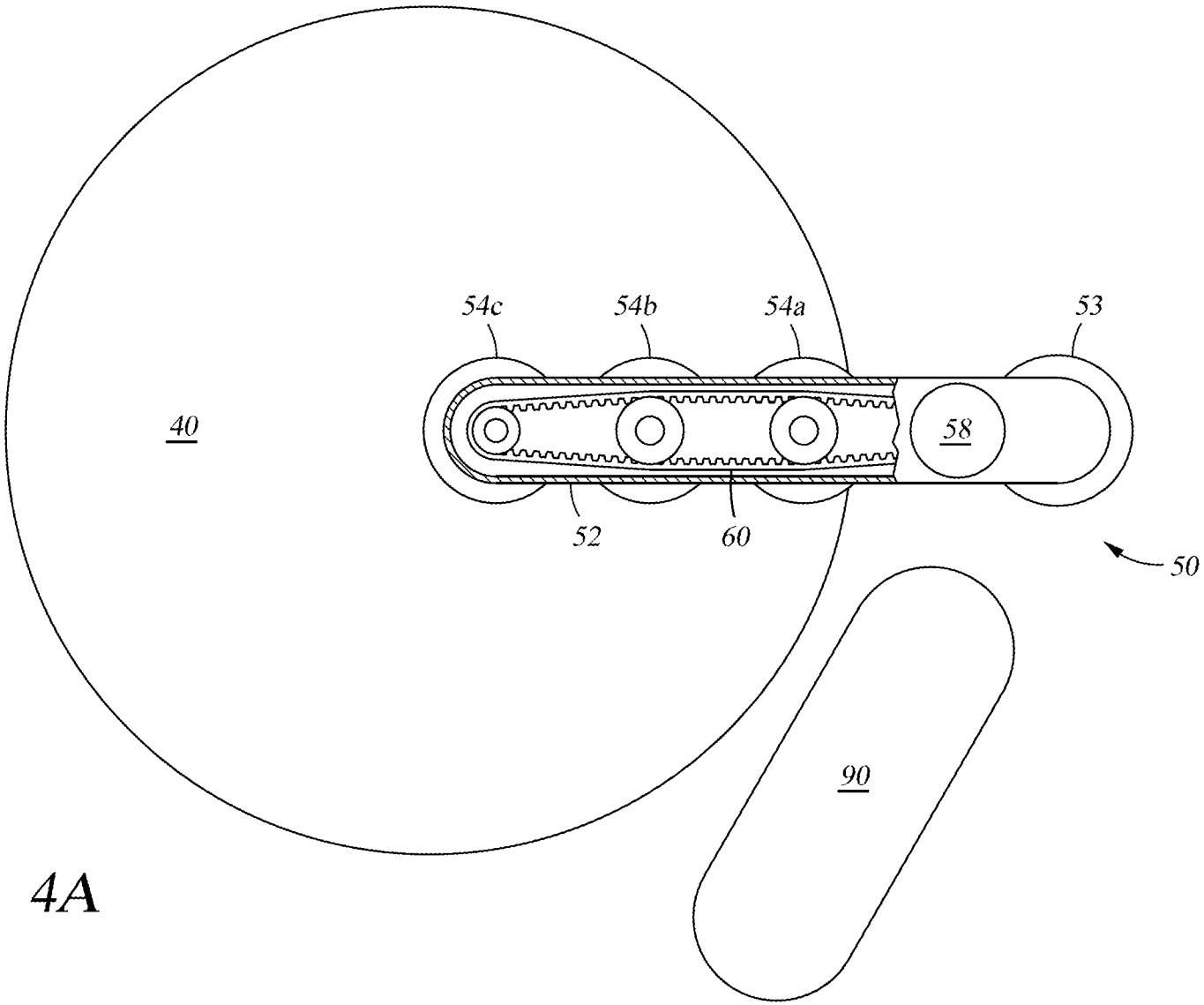
FIGS. 4A and 4B provide schematic top views of an embodiment of the multiple disk pad conditioner of the present disclosure.
Figure 4B:
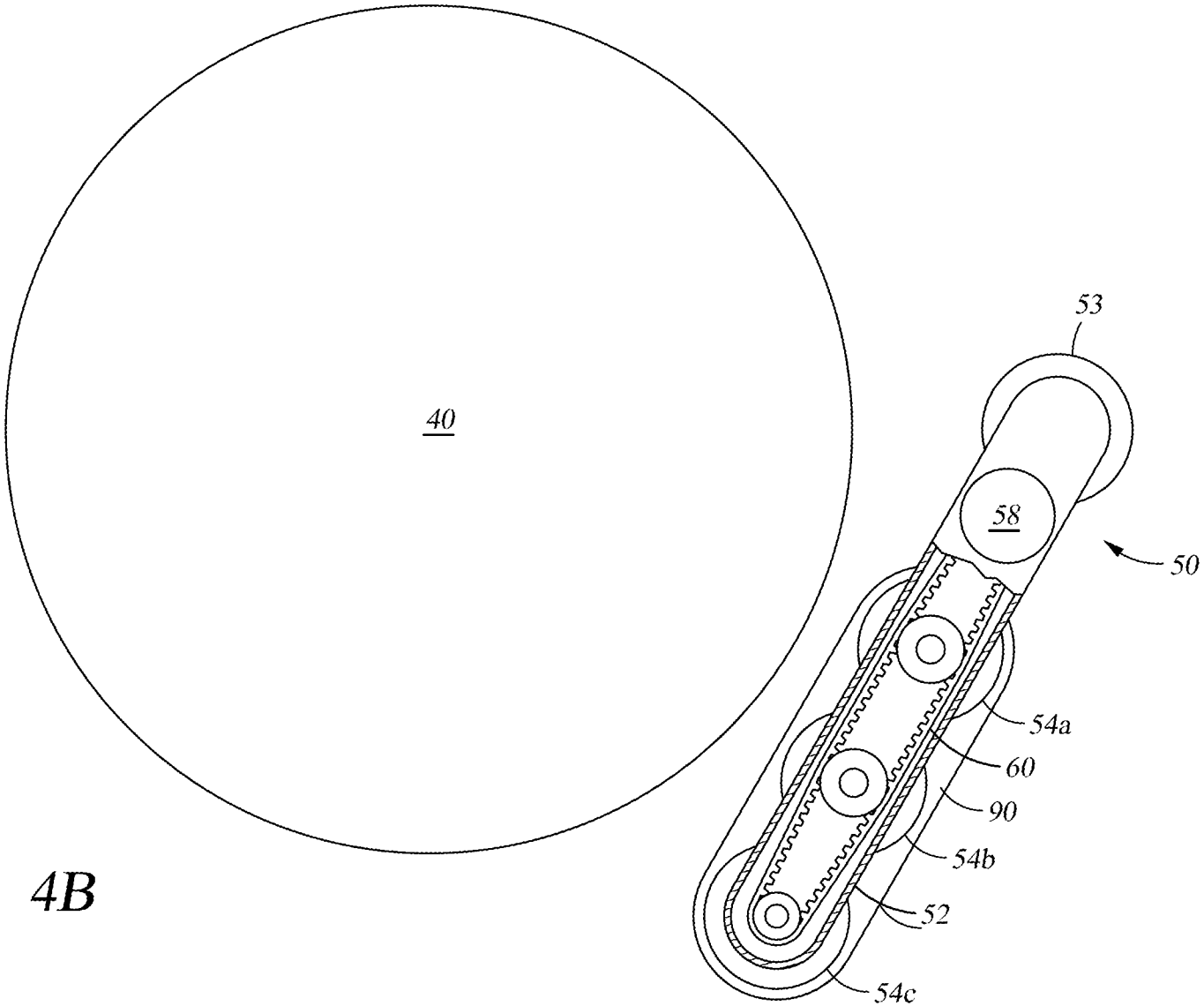

FIGS. 4A and 4B provide schematic top views of an embodiment of the multiple disk pad conditioner 50 of the present disclosure. To prepare for conditioning, and as shown in FIG. 4A, the conditioning arm 52 is rotated about the conditioning base 51 such that the conditioning heads 54*a*, 54*b*, and 54*c* are positioned over the polishing pad 40. To perform conditioning, pneumatic or mechanical actuators (not shown) inside the conditioning heads 54*a*, 54*b*, and 54*c* adjust the vertical position of the conditioning disks 56*a*, 56*b*, and 56*c* to engage the polishing pad 40. As discussed previously, the pressure applied to the conditioning disks 56*a*, 56*b*, and 56*c* may be uniformly applied by a single EPR or, in alternate embodiments, the pressure may be independently applied to each of the individual conditioning disks 56*a*, 56*b*, and 56*c*.

During conditioning, the conditioning disks 56*a*, 56*b*, and 56*c* housed within the conditioning heads 54*a*, 54*b*, and 54*c* are rotated in a predefined direction. The predefined direction may be counter-clockwise or clockwise as viewed from a top side of the polishing station. In the embodiment shown in FIGS. 4A and 4B, the conditioning disks 56*a*, 56*b*, and 56*c* are driven by a single motor 58 imparting rotational force through one or more belts 60 to the conditioning heads 54*a*, 54*b*, and 54*c* and/or the conditioning disks 56*a*, 56*b*, and 56*c*. It should be understood that in alternate embodiments, chains, roller chains, sprockets, or other mechanisms known in the art can be used to drive the rotation of the conditioning disks It should also be understood that in alternate embodiments, individual motors (not shown) or gearing mechanisms can be used to drive the conditioning disks 56*a*, 56*b*, and 56*c* independently.

The polishing station 20 can also include a cleaning station 90, which contains a cleaning liquid for rinsing or cleaning the conditioning disks 56*a*, 56*b*, and 56*c*. As shown in FIG. 4B, the conditioning arm 52 has moved the conditioning heads 54*a*, 54*b*, and 54*c* away from the polishing pad 40 and into position atop the cleaning station 90. The cleaning step can occur while new substrates are being polished or switched out.

Figure 5:
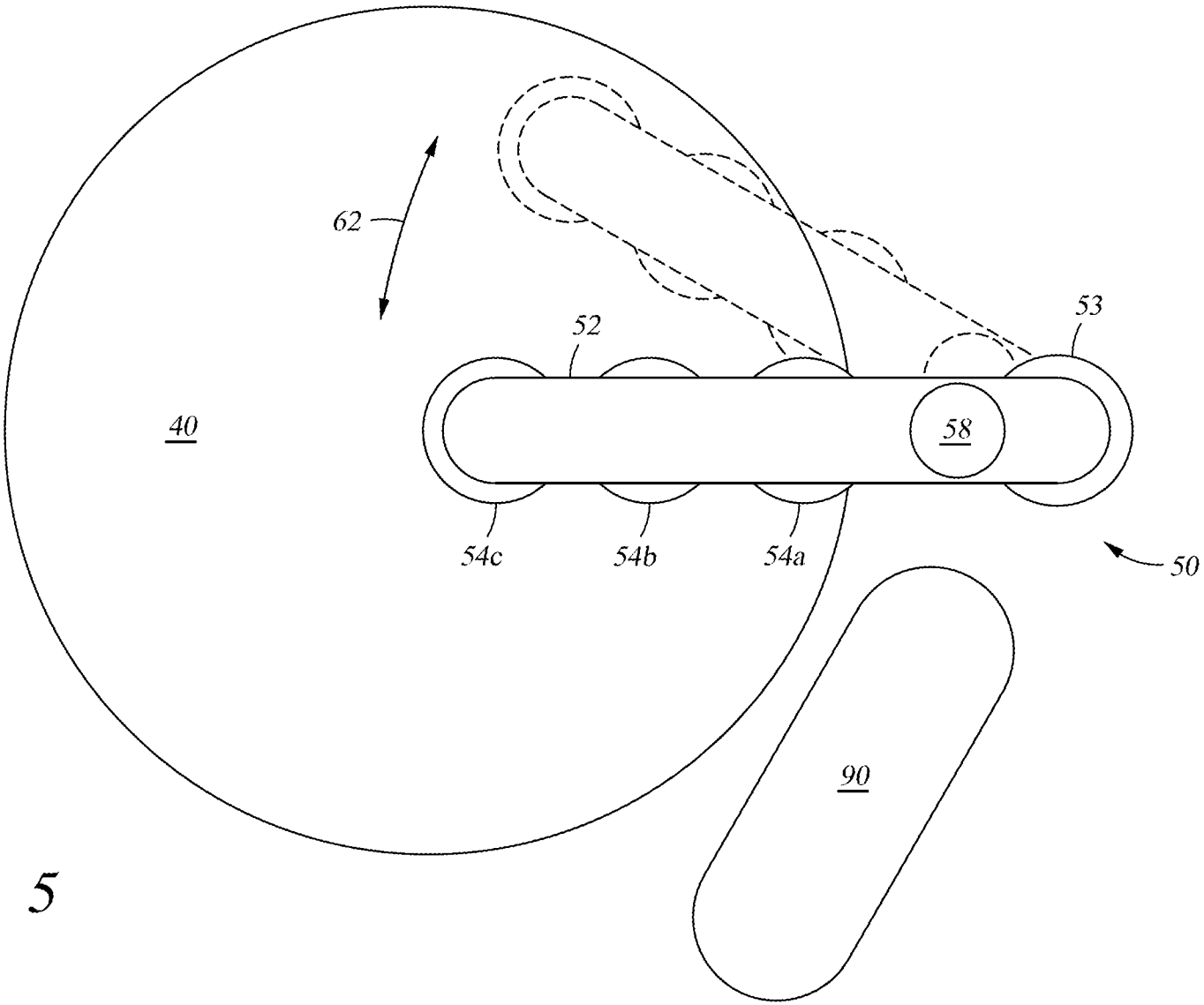
FIG. 5 provides a schematic top view of an embodiment of the multiple disk pad conditioner of the present disclosure in a conditioning position.

In the embodiment shown in FIGS. 4A and 4B, the conditioning arm 52, while the conditioning disks 56*a*, 56*b*, and 56*c* are engaged with the polishing pad 40, may remain stationary or sweep a small amount such that each conditioning disk 56*a*, 56*b*, and 56*c* works on a certain radial zone of the polishing pad 40. In alternate embodiments, such as shown in FIG. 5, the conditioning arm 52 may sweep to the edge of the polishing pad 40 such that the conditioning disks 56*a*, 56*b*, and 56*c* may simultaneously work on either multiple zones or similar zones on the surface of the polishing pad 40, depending upon the radial position of the conditioning arm 52, upon the polishing pad 40.

Figure 6A:
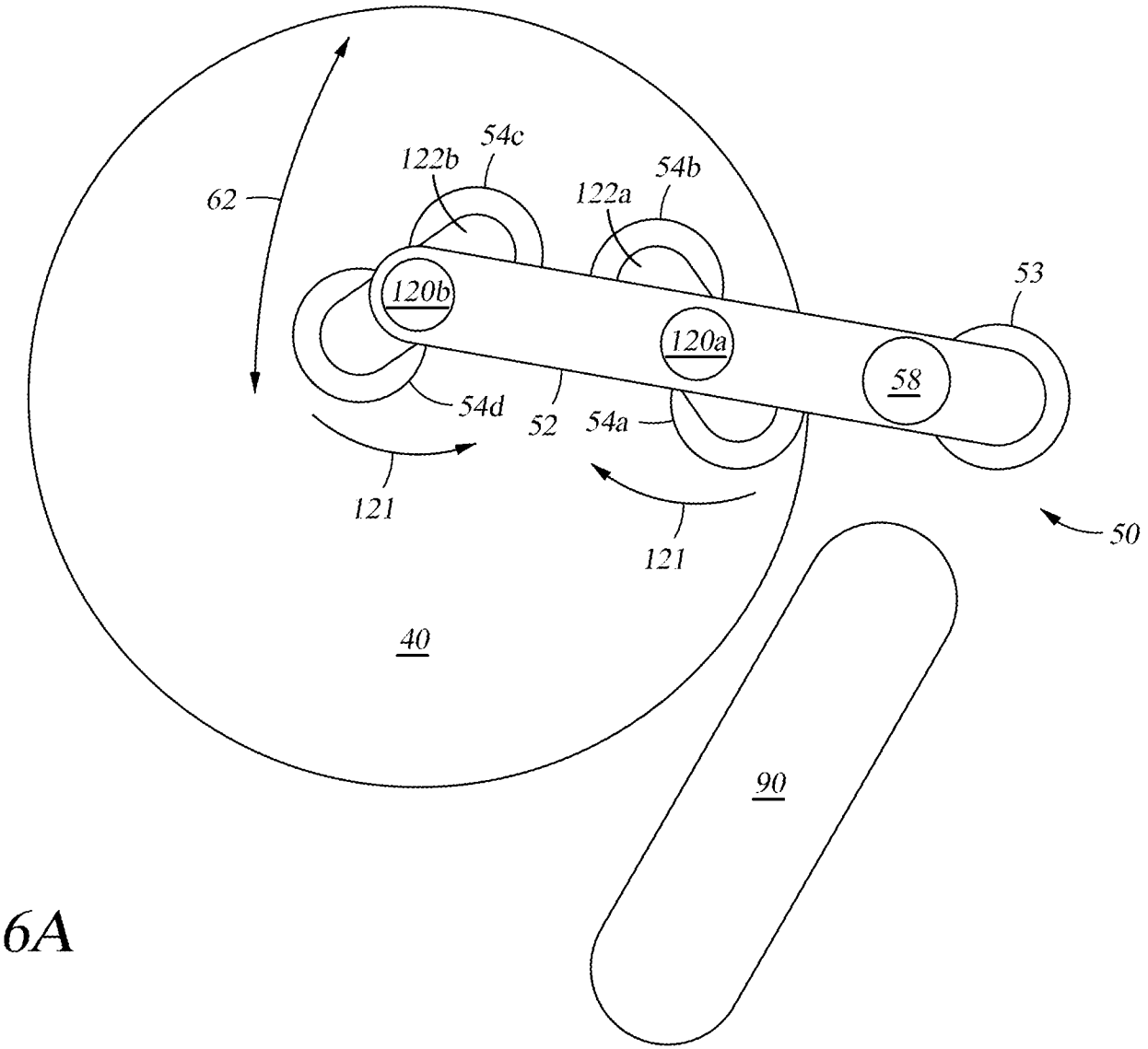
FIGS. 6A and 6B provide schematic top views of another embodiment of the multiple disk pad conditioner of the present disclosure.
Figure 6B:
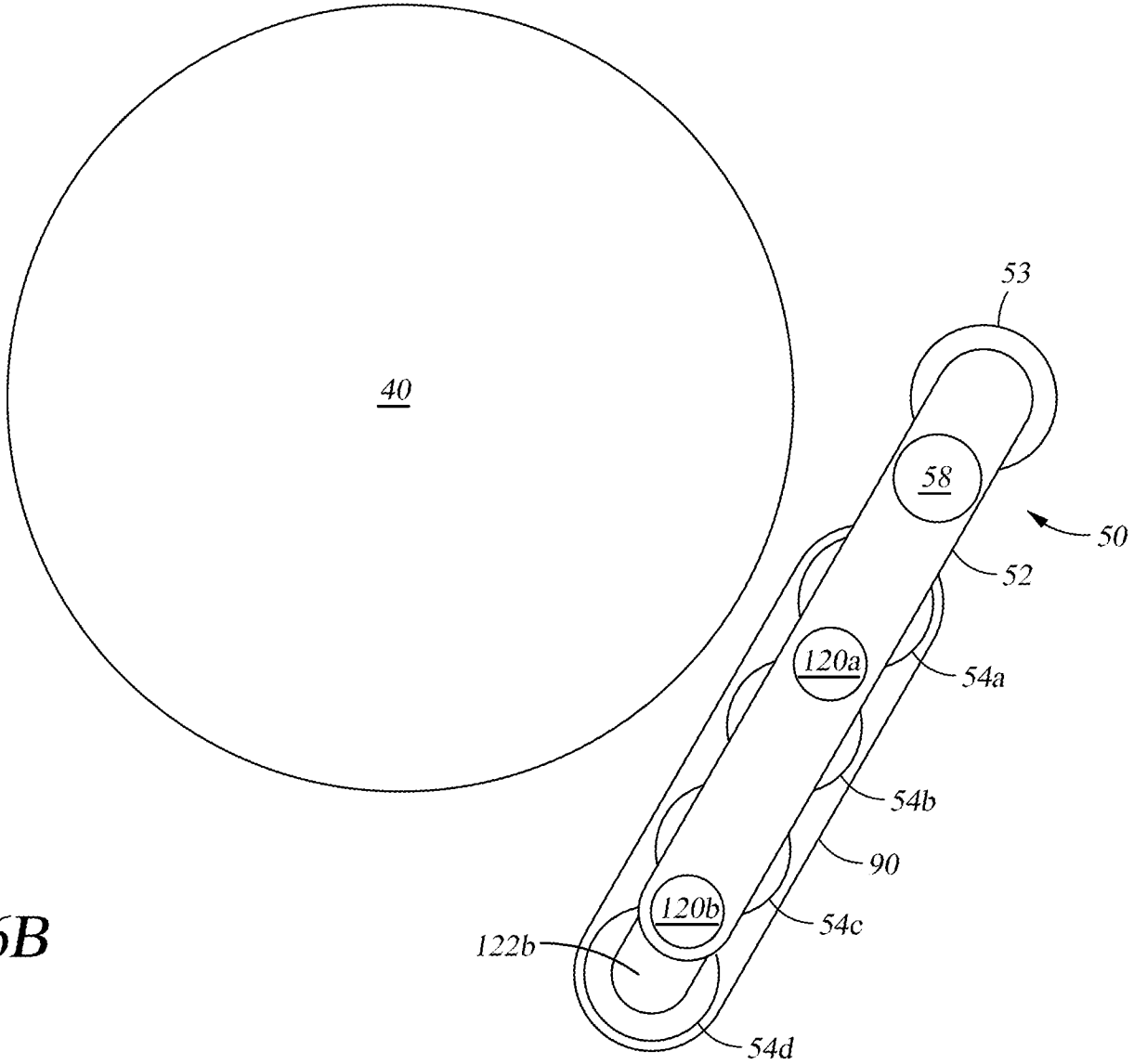
Figure 7A:
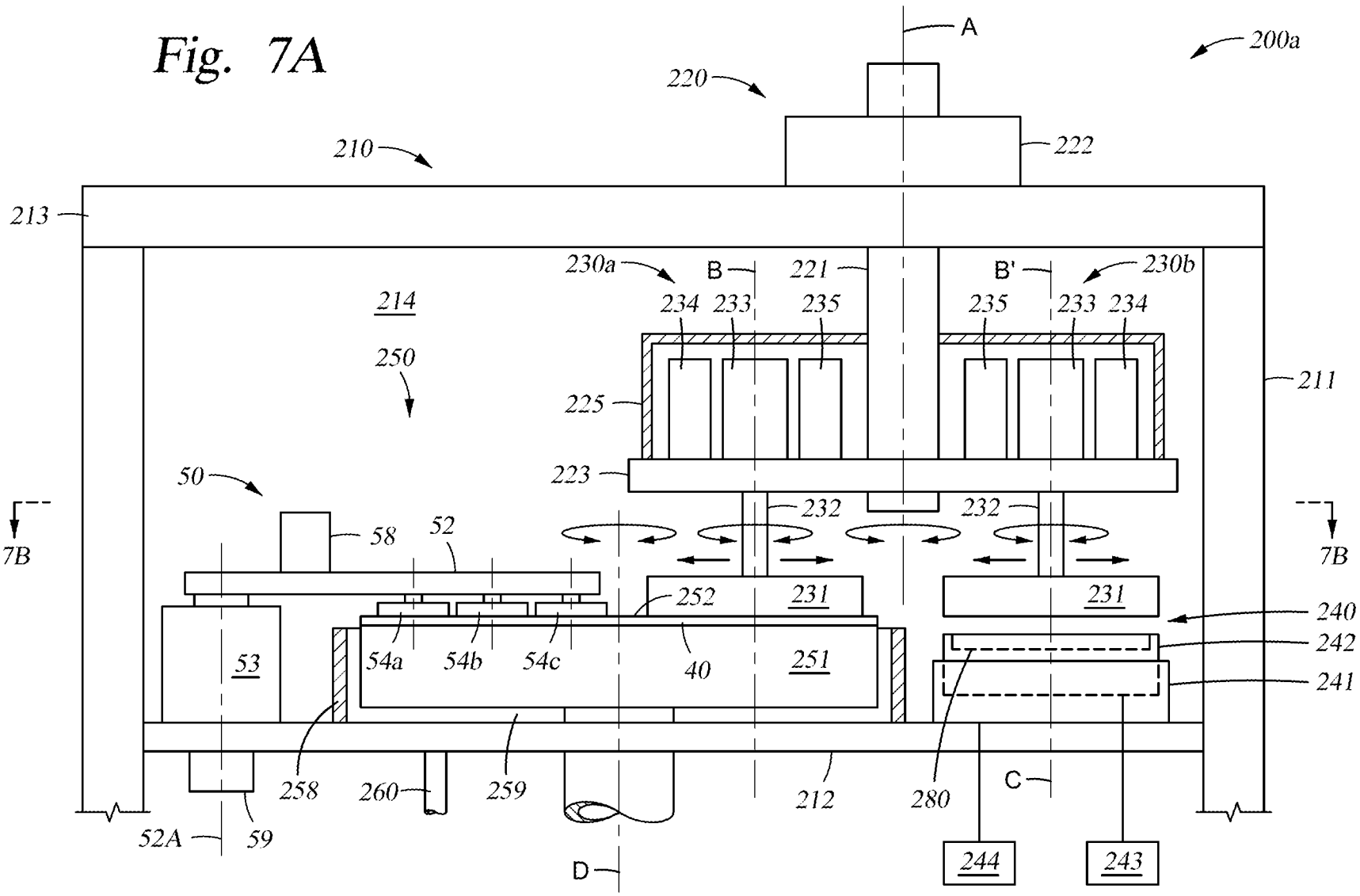
FIGS. 7A and 7B are schematic side views of top down section views, respectively, of an embodiment of the multiple disk pad conditioner of the present disclosure used as part of a polishing module.

An alternate embodiment of the multiple disk pad conditioner 50 of the present disclosure is shown in FIGS. 6A and 6B. FIG. 6A shows the multiple disk pad conditioner 50 in a conditioning position and FIG. 6B shows the multiple disk pad conditioner 50 in a cleaning position. In this embodiment, there are a plurality (two shown) of conditioning head pivot bases 120*a*, 120*b*, each pivot base 120*a*, 120*b*, having a conditioning head pivot arm 122*a*, 122*b* that is rotationally affixed to the conditioning arm 52 such that the conditioning head pivot arms 122*a*, 122*b* may rotate about the pivot bases 120*a*, 120*b* as indicated by the arrows 121. It should be understood that the rotation of the pivot arms 122*a*, 122*b* may be controlled by the actuator 58 in combination with other actuators, belts, or other known mechanisms. It should also be understood that the rotation of the pivot arms 122*a*, 122*b* may be uniform at the same RPM or independently controlled for each pivot arm 122*a*, 122*b*.

In the embodiment shown in FIGS. 6A and 6B, the pivot arms 122*a*, 122*b* further comprise one or more conditioning heads. In the embodiment shown, each pivot arm 122*a*, 122*b* has two conditioning heads (54*a*, 54*b*, 54*c*, and 54*d*), but other embodiments may have any number of conditioning heads depending on the specifications and requirements of the particular conditioning application. As discussed with the previous embodiments of the present disclosure, the conditioning heads 54*a*, 54*b*, 54*c*, and 54*d* further comprise abrasive disks or abrasive regions for engaging the polishing pad, and the conditioning heads 54*a*, 54*b*, 54*c*, and 54*d* may rotate, either uniformly at the same RPM or independently.

As illustrated in FIG. 6A, in this embodiment, the polishing pad 40 is engaged by the multiple disk conditioner 50 such that the conditioning arm 52 is sweeping while the conditioning heads 54*a*, 54*b*, 54*c*, and 54*d* are independently rotating, and while the pivot arms 122*a*, 122*b* are rotating, resulting in increased efficiency of the conditioning process as the conditioning disks 56*a*, 56*b*, 56*c*, and 56*d* housed within the conditioning heads 54*a*, 54*b*, 54*c*, and 54*d* are able to address multiple regions of the polishing pad 40 simultaneously. Once the conditioning process is complete, as shown in FIG. 6B, the conditioning heads 54*a*, 54*b*, 54*c*, and 54*d* of this embodiment may be rotated into a linear alignment for access to the cleaning station 90.

Figure 7B:
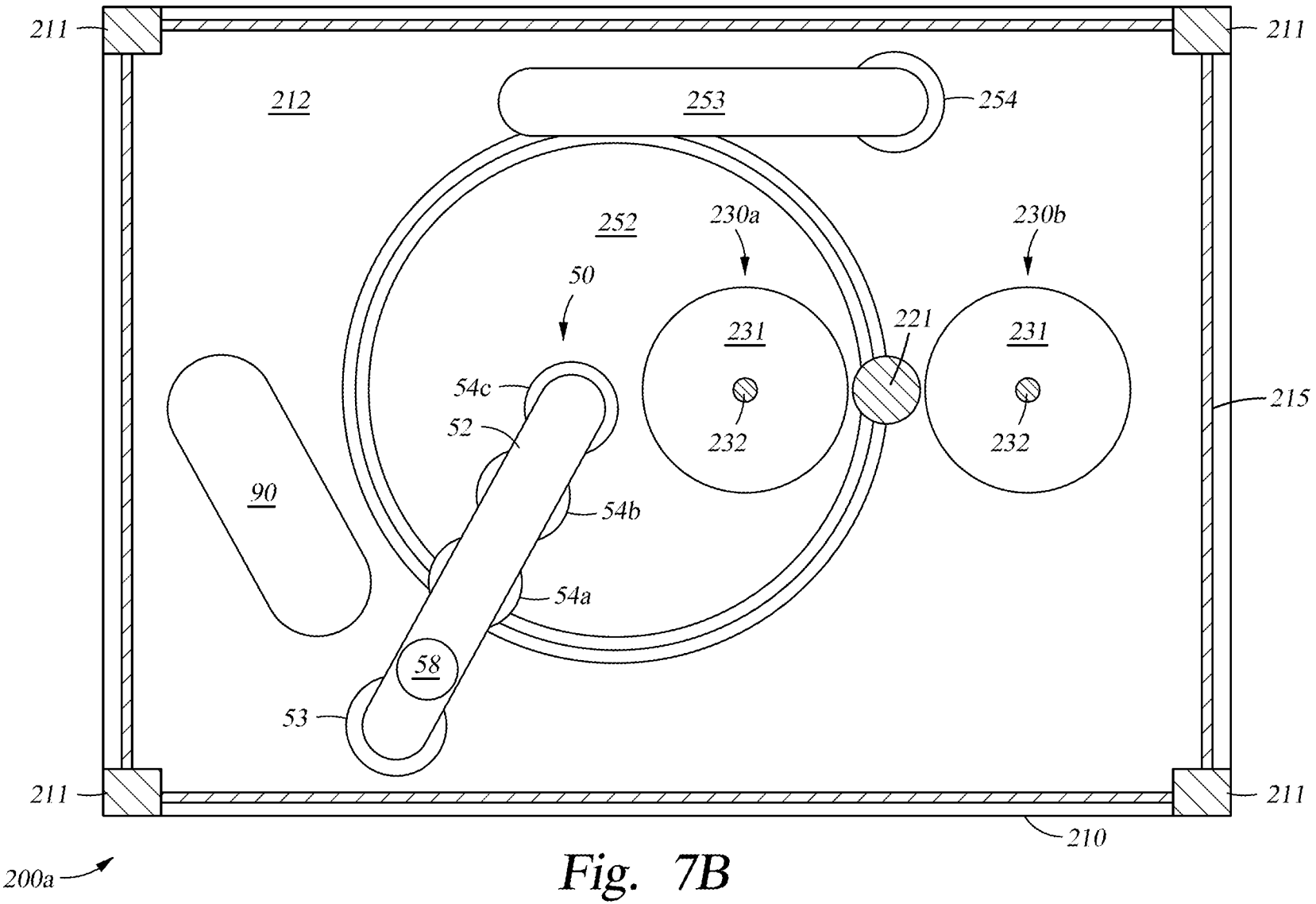

FIGS. 7A and 7B show Embodiments of the multi disk pad conditioner of the present disclosure used in a high throughput density CMP system. FIG. 7A is a schematic side view of a the high throughput CMP polishing system, according to one embodiment, which may be used as one or more of a plurality of polishing modules as described herein. FIG. 7B is a top down sectional view of FIG. 7A taken along line A-A.

Here, the polishing module 200*a* is disposed within a modular frame 210 and includes a carrier support module 220 comprising a first carrier assembly 230*a* and a second carrier assembly 230*b* where each of the carrier assemblies 230*a*, 230*b* includes a corresponding carrier head 231. The polishing module 200*a* further comprises a station for loading and unloading substrates to and from the carrier heads, herein a carrier loading station 240, and a polishing station 250. In embodiments herein, the carrier support module 220, the carrier loading station 240, and the polishing station 250 are disposed in a one-to-one-to-one relationship within the modular frame 210. This one-to-one-to-one relationship and the arrangements described herein facilitate the simultaneous substrate loading/unloading and polishing operations of at least two substrates 280 to enable the high throughput density substrate handling methods described herein.

Here, the modular frame 210 features a plurality of vertically disposed supports, herein upright supports 211, a horizontally disposed tabletop 212, and an overhead support 213 disposed above the tabletop 212 and spaced apart therefrom. The upright supports 211, the tabletop 212, and the overhead support 213 collectively define a processing region 214. Here, the modular frame 210 has a generally rectangular footprint when viewed from the top down (FIG. 7B) where four individual ones of the upright supports 211 are respectively coupled to the four outward facing corners of both the tabletop 212 and the overhead support 213. In other embodiments, the tabletop 212 and the overhead support 213 may be coupled to upright supports 211 at other suitable locations which have been selected to prevent interference between the upright supports 211 and substrate handling operations. In other embodiments, the modular frame 210 may comprise any desired footprint shape when viewed from the top down.

In some embodiments, the polishing module 200*a* further includes a plurality of panels 215 each vertically disposed between adjacent corners of the modular frame 210 to enclose and isolate the processing region 214 from other portions of a modular polishing system 200. In those embodiments, one or more the panels 215 will typically have a slit shaped opening (not shown) formed therethrough to accommodate substrate transfer into and out of the processing region 214.

Here, the carrier support module 220 is suspended from the overhead support 213 and includes a support shaft 221 disposed through an opening in the overhead support 213, an actuator 222 coupled to the support shaft 221, and a carrier platform 223 coupled to, and supported by, the support shaft 221. The actuator 222 is used to rotate or alternately pivot the support shaft 221, and thus the carrier platform 223, about a support shaft axis A in the clockwise and counterclockwise directions. In other embodiments (not shown), the support shaft 221 may be mounted on and/or coupled to the base 212 to extend upwardly therefrom. In those embodiments, the carrier platform 221 is coupled to, disposed on, and/or otherwise supported by an upper end of the support shaft 221. In those embodiments, the support shaft 221 may be vertically disposed in an area between the carrier loading station 240 and the polishing station 250 which are described below.

As shown, the carrier platform 223 provides support to the carrier assemblies 230*a*, 230*b* and is coupled to an end of the support shaft 221 which is disposed in the processing region 214. Here, the carrier platform 223 comprises an upper surface and a lower tabletop-facing surface which is opposite of the upper surface. The carrier platform 223 is shown as a cylindrical disk but may comprise any suitable shape sized to support the components of the carrier assemblies 230*a*, 230*b*. The carrier platform 223 is typically formed of a relatively light weight rigid material, such as aluminum which is resistant to the corrosive effects of commonly used polishing fluids. In some embodiments, the carrier support module 220 further includes a housing 225 disposed on the upper surface of the carrier platform 223. The housing 225 desirably prevents polishing fluid overspray from the polishing process from coming into contact with, and causing corrosion to, the components disposed on or above the carrier platform 223 in a region defined by the housing 225. Beneficially, the housing 225 also prevents contaminants and/or other defect causing particles from transferring from the components contained therein to the substrate processing regions which might otherwise cause damage to the substrate surface, such as scratches and/or other defectivity.

As shown, the carrier platform 223 provides support for two carrier assemblies, the first carrier assembly 230*a* and the second carrier assembly 230*b*, so that the carrier support module 220 and the carrier assemblies 230*a*, 230*b* are arranged in a one-to-two relationship within the modular frame 210. Thus, the carrier support module 220, the carrier assemblies 230*a*, 230*b*, the carrier loading station 240, and the polishing station 250 are arranged in a one-to-two-to-one-to-one relationship within the modular frame 210. In some embodiments, the carrier support module 220 supports only a single carrier assembly, such as the first carrier assembly 230*a*. In some embodiments, the carrier support module 220 supports not more than two carrier assemblies, such as the first carrier assembly 230*a* and the second carrier assembly 230*b*. In some embodiments, a carrier support module 220 is configured to support not more and not less than the two carrier assemblies 230*a*, 230*b*.

Typically, each of the carrier assemblies 230*a*, 230*b* comprises a carrier head 231, a carrier shaft 232 coupled to the carrier head 231, one or a plurality of actuators, such as a first actuator 233 and a second actuator 234, and a pneumatic assembly 235. Here, the first actuator 233 is coupled to the carrier shaft 232 and is used to rotate the carrier shaft 232 about a respective carrier axis B or B'. The second actuator 234 is coupled to the first actuator 233 and is used to oscillate the carrier shaft 232 a distance (not shown) between a first position with respect to the carrier platform 221 and a second position disposed radially outward from the first position or to positions disposed therebetween. Typically, the carrier shaft 232 is oscillated during substrate polishing to sweep the carrier head 231, and thus a substrate 280 disposed therein, between an inner diameter of a polishing pad 40 and an outer diameter of the polishing pad 40 to, at least in part, prevent uneven wear of the polishing pad 40. Beneficially, the linear (sweeping) motion imparted to the carrier head 231 by oscillating the carrier shaft 232 may also be used to position the carrier head 231 on the polishing pad 40 such that the carrier head 231 does not interfere with the positioning of the polishing fluid dispense arm 253 and/or multiple disk pad conditioning arm 52 (FIG. 7B).

The carrier shafts 232 are disposed through openings disposed through the carrier platform 223. Typically, the actuators 233 and 234 are disposed above the carrier platform 223 and are enclosed within the region defined by the carrier platform 223 and the housing 225. The respective positions of the openings in the carrier platform 223 and the position of the carrier shafts 232 disposed through the openings determines a swing radius of a carrier head 231 as it is moved from a substrate polishing to a substrate loading or unloading position. The swing radius of a carrier head 231 can determine minimum spacing between polishing modules 200*a* in the modular polishing systems described herein as well as the ability to perform processes within a processing module that are ex-situ to the polishing process, i.e., not conducted concurrently therewith.

In some embodiments, the swing radius of a carrier head 231 is not more than about 2.5 times the diameter of a to-be-polished substrate, such as not more than about 2 times the diameter of a to-be-polished substrate, such as not more than about 1.5 times the diameter of a to-be-polished substrate. For example, for a polishing module 100*a* configured to polish a 300 mm diameter substrate the swing radius of the carrier head 231 may be about 750 mm or less, such as about 600 mm or less, or about 450 mm or less. Appropriate scaling may be used for polishing modules configured to polish other sized substrates. The swing radius of a carrier head 231 may be more, less, or the same as a swing radius of the carrier platform 223. For example, in some embodiments the swing radius of the carrier head 231 is equal to or less than the swing radius of the carrier platform 223.

Here, each carrier head 231 is fluidly coupled to a pneumatic assembly 235 through one or more conduits (not shown) disposed through the carrier shaft 232. The term "fluidly coupled" as used herein refers to two or more elements that are directly or indirectly connected such that the two or more elements are in fluid communication, i.e., such that a fluid may directly or indirectly flow therebetween. Typically, the pneumatic assembly 235 is fluidly coupled to the carrier shaft 232 using a rotary union (not shown) which allows the pneumatic assembly 235 to remain in a stationary position relative to the carrier platform 223 while the carrier head 231 rotates therebeneath. The pneumatic assembly 235 provides pressurized gases and/or vacuum to the carrier head 231, e.g., to one or more chambers (not shown) disposed within the carrier head 231. In other embodiments, one or more functions performed by components of the pneumatic assembly 235 as described herein may also be performed by electromechanical components, e.g., electromechanical actuators.

The carrier head 231 will often feature one or more of flexible components, such as bladders, diaphragms, or membrane layers (not shown) which may, along with other components of the carrier head 231, define chambers disposed therein. The flexible components of the carrier head 231 and the chambers defined therewith are useful for both substrate polishing and substrate loading and unloading operations. For example, a chamber defined by the one or more flexible components may be pressurized to urge a substrate disposed in the carrier head towards the polishing pad by pressing components of the carrier head against the backside of the substrate. When polishing is complete, or during substrate loading operations, a substrate may be vacuum chucked to the carrier head by applying a vacuum to the same or a different chamber to cause an upward deflection of a membrane layer in contact with the backside of the substrate. The upward deflection of the membrane layer will create a low pressure pocket between the membrane and the substrate, thus vacuum chucking the substrate to the carrier head 231. During substrate unloading operations, where the substrate is unloaded from the carrier head 231 into the carrier loading station 240, a pressurized gas may be introduced into the chamber. The pressurized gas in the chamber causes a downward deflection of the membrane to release a substrate from the carrier head 231*a*, 231*b* into the carrier loading station 240.

Here, the carrier loading station 240 has a load cup comprising a basin 241, a lift member 242 disposed in the basin 241, and an actuator 243 coupled to the lift member 242. In some embodiments, the carrier loading station 240 is coupled to a fluid source 244 which provides cleaning fluids, such as deionized water, which may be used to clean residual polishing fluids from a substrate 280 and/or carrier head 231 before and/or after substrate polishing. Typically, a substrate 280 is loaded into the carrier loading station 240 in a "face down" orientation, i.e., a device side down orientation. Thus, to minimize damage to the device side surface of the substrate through contact with surfaces of the lift member 242, the lift member 242 will often comprise an annular substrate contacting surface which supports the substrate 280 about the circumference, or about portions of the circumference, thereof. In other embodiments, the lift member 242 will comprise a plurality of lift pins arranged to contact a substrate 280 proximate to, or at, the outer circumference thereof. Once a substrate 280 is loaded into the carrier loading station 240 the actuator 243 is used to move the lift member 242, and thus the substrate 280, towards a carrier head 231 positioned thereabove for vacuum chucking into the carrier head 231. The carrier head 231 is then moved to the polishing station 250 so that the substrate 180 may be polished thereon.

In other embodiments, the carrier loading station 240 features buff platen that may be used to buff, e.g., soft polish, the substrate surface before and/or after the substrate is processed at the polishing station. In some of those embodiments, the buff platen is movable in a vertical direction to make room for substrate transfer to and from the carrier loading station using a substrate transfer and/or to facilitate substrate transfer to and from the carrier heads 231. In some embodiments, the carrier loading station 240 is further configured as an edge correction station, e.g., to remove material from regions proximate to the circumferential edge of the substrate before and/or after the substrate is processed at the polishing station 250. In some embodiment, the carrier loading station 240 is further configured as a metrology station and/or a defect inspection station, which may be used to measure the thickness of a material layer disposed on the substrate before and/or after polishing, to inspect the substrate after polishing to determine if a material layer has been cleared from the field surface thereof, and/or to inspect the substrate surface for defects before and/or after polishing. In those embodiments, the substrate may be returned to the polishing pad for the further polishing and/or directed to a different substrate processing module or station, such as a different polishing module 200 or to an LSP module 330 (shown on FIG. 8) based on the measurement or surface inspection results obtained using the metrology and/or defect inspection station.

Here, a vertical line disposed through the center C of the carrier loading station 240 is co-linear with the center of a circular substrate 280 (e.g., a silicon wafer when viewed top down). As shown the center C is co-linear with the shaft axis B or B' when a substrate 280 is being loaded to or unloaded from a carrier head 231 disposed thereover. In other embodiments, the center C of the substrate 280 may be offset from the shaft axis B when the substrate 280 is disposed in the carrier head 231.

The polishing station 250 features a platen 251, a polishing pad 40, a polishing fluid dispense arm 253, an actuator (not shown) coupled to the fluid dispense arm 253, a pad conditioning arm 52, a motor, or actuator 58 coupled to a first end of the pad conditioning arm 52, pad conditioning heads 54*a*, 54*b*, and 54*c*, and a cleaning station 90. The pad conditioning heads 54*a*, 54*b*, and 54*c* are coupled to the pad conditioning arm 52. In other embodiments, the fluid dispense arm 253 may be disposed in a fixed position relative to the rotational center of the polishing platen 251. In some embodiments, the fluid dispense arm 253 may be curved so as to avoid interference with the carrier heads 231 as the carrier heads 231 are rotated by the actuator 222 coupled to the carrier platform 223.

Here, the polishing station 250 further includes a fence 258 (FIG. 7A) which surrounds the polishing platen 251 and is spaced apart therefrom to define a drainage basin 259 (FIG. 7A). Polishing fluid and polishing fluid byproducts are collected in the drainage basin 259 and are removed therefrom through a drain 260 in fluid communication therewith. In other embodiments, the fence 258 may comprise one or more sections disposed about, or partially disposed above, respective portions of the polishing platen 251, and/or may comprises one or more sections disposed between the carrier loading station 240 and the polishing station 250. Here, the platen 251 is rotatable about a platen axis D which extends vertically through the center of the platen 251. Here, the polishing station 250 features a single platen 251 so that the carrier support module 220, the carrier loading station 240, and the platen 251 are disposed in a one-to-one-to-one relationship.

Here, the fluid dispense arm 253 (FIG. 7B) is configured to dispense polishing fluids at or proximate to the center of the polishing pad, i.e., proximate to platen axis D disposed therethrough. The dispensed polishing fluid is distributed radially outward from the center of the platen 251 by centrifugal force imparted to the polishing fluid by the rotation of the platen 251. For example, here the actuator 254 is coupled to a first end of the fluid dispense arm 253 and is used to rotationally move the fluid dispense arm 253 so that a second end of the fluid dispense arm 253 may be positioned over or proximate to the center of the platen 251 and the polishing pad 40 disposed thereon.

The pad conditioning arm 52 comprises a first end coupled to the actuator 59, which is disposed with the conditioning base 53, and a second end coupled to the pad conditioning heads 54*a*, 54*b*, and 54*c*. The actuator 59 swings the pad conditioning arm 52 about the arm axis 52A of the conditioning base 53. As discussed above one or more down-force actuators are configured to simultaneously urge the pad conditioning heads 54*a*, 54*b*, and 54*c* toward the surface of the polishing pad 40 disposed therebeneath. As discussed herein, the pad conditioning heads 54*a*, 54*b*, and 54*c* typically include a brush or a fixed abrasive conditioning, e.g., a diamond embedded condition disk (56*a*, 56*b*, 56*c* described herein), which is used to abrade and rejuvenate the polishing surface 252 of the polishing pad 40.

Here, the pad conditioning heads 54*a*, 54*b*, and 54*c* are urged against the polishing pad 40 while being swept back and forth from an outer diameter of the polishing pad 40 to, or proximate to, the center of the polishing pad 40 while the platen 251, and thus the polishing pad 40, rotate therebeneath. The multiple disk pad conditioner 50 of the present disclosure is used for in-situ conditioning, i.e., concurrent with substrate polishing, ex-situ conditioning, i.e., in periods between substrate polishing, or both. Typically, the pad conditioning heads 54*a*, 54*b*, and 54*c* are urged against the polishing pad 40 in the presence of a fluid, such as polishing fluid or deionized water, which provides lubrication therebetween. The fluid is dispensed onto the polishing pad 40 near the platen axis D by positioning the fluid dispense arm 253 thereover. Typically, the carrier support module 220 and the polishing station 250 are arranged so that the swing radius of a carrier head 231 is not within a swing path of one or both of the fluid dispense arm 253 or the multiple disk pad conditioner 50. This arrangement beneficially allows for ex-situ conditioning of the polishing pad 40 while the carrier support module 220 pivots the carrier heads 231 between the carrier loading and substrate polishing positions as further described below.

Typically, the carrier support module 220, the carrier assemblies 230*a*, 230*b*, the carrier loading station 240, and the polishing station 250 are disposed in an arrangement that desirably minimizes the cleanroom footprint of the polishing module 100*a*. Herein, a description of the arrangement is made using the relative positions of the carrier heads 231, carrier loading station 240, and platen 251 when the carrier support module 220 is disposed in one of a first or second processing mode.

In FIGS. 7A-7B, the carrier support module 220 is disposed in a first processing mode. In the first processing mode the first carrier assembly 230*a* is disposed above the platen 251 and the second carrier assembly 230*b* is disposed above the carrier loading station 240. In one example, in the first processing mode the carrier head 231 of the second carrier assembly 230*b* is positioned above the carrier loading station 240 to allow for substrate loading and unloading thereinto and therefrom. In a second processing mode (not shown) the carrier platform 223 will be rotated or pivoted an angle θ of 180° about the support shaft axis A and the relative positions of the first carrier assembly 230*a* and the second carrier assembly 230*b* will be reversed. In this example, in the second processing mode the carrier head 231 of the second carrier assembly 230*a* will be positioned above the carrier loading station 240 to allow for substrate loading and unloading thereinto and therefrom.

Figure 8:
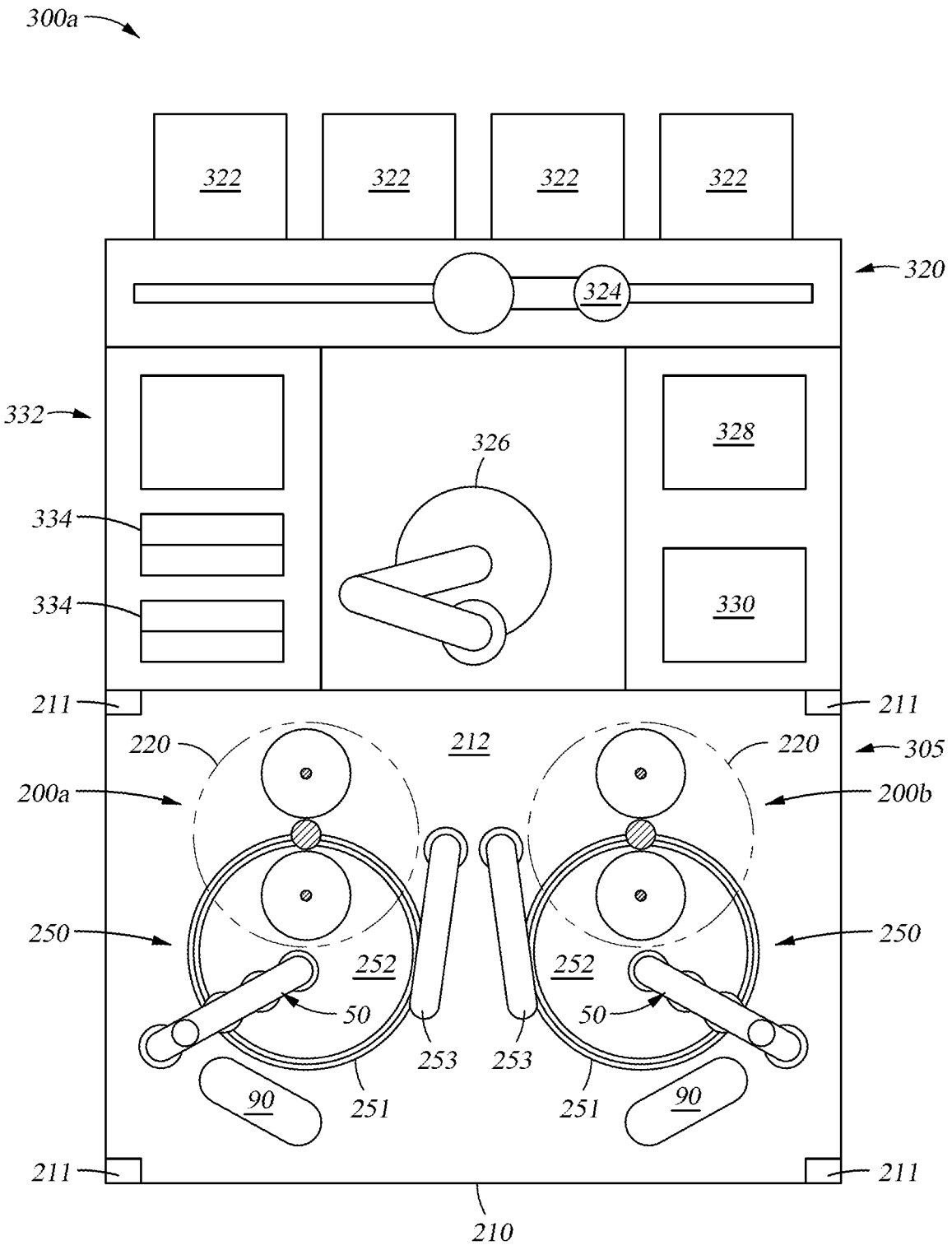
FIG. 8 schematically illustrates an alternate arrangement of the polishing module of FIGS. 7A-7B.

FIG. 8 is a schematic top down sectional view of a modular polishing system comprising a plurality of the polishing modules having multiple disk pad conditioners as set forth in FIGS. 7A-7B, according to one embodiment. Here, the modular polishing system 300*a* features a first portion 320 and a second portion 305 coupled to the first portion 320. The second portion 305 includes two polishing modules 200*a*, 200*b* which share a frame 210 including upright supports 211, a shared tabletop 212, and a shared overhead support 213 (such as shown in in FIG. 7A). In other embodiments, each of the polishing modules 200*a*, 200*b* respectively comprise individual frames 210 (such as shown in FIGS. 7A-7B) which are coupled together to form the second portion 305.

Each of the polishing modules 200*a*, 200*b* feature a carrier support module 220, a carrier loading station 240, and a polishing station 250 disposed in a one-to-one-to-one relationship as shown and described in FIGS. 7A-7B. Each of the polishing stations 250 of the respective polishing modules 200*a*, 200*b* features a single platen 251 so that each of the respective polishing modules 200*a*, 200*b* comprise a carrier support module 220, a carrier loading station 240, and a platen 251 disposed in a one-to-one-to-one relationship as shown and described in FIGS. 7A-7B.

Typically, the polishing module 200*b* is substantially similar to an embodiment of the polishing module 200*a* described in FIGS. 7A-7B, and may include alternate embodiments, or combinations of alternate embodiments, thereof. For example, in some embodiments, one of the two polishing modules, e.g., polishing module 200*a*, is configured to support a longer material removal polishing process while the other polishing module, e.g., 200*b* is configured to support a shorter post-material removal buffing process. In those embodiments, substrates processed on polishing modules 200*a* are then transferred to polishing module 200*b*. Often, the shorter post-material removal buffing process will be a throughput limiting process which will benefit from the throughput increasing two carrier assembly 230*a*, 230*b* arrangement described in FIGS. 7A-7B. Thus, in some embodiments, one or more substrate polishing modules within a modular polishing system may comprise a single carrier assembly 230*a* or 230*b* while other polishing modules within the modular polishing system comprise two carrier assemblies 230*a* and 230*b*.

Typically, the first portion 320 comprises one or combination of a plurality of system loading stations 222, one or more substrate handlers, e.g., a first robot 324 and a second robot 326, one or more metrology stations 328, one or more location specific polishing (LSP) module 330, and one or more one or more post-CMP cleaning systems 332. An LSP module 330 is typically configured to polish only a portion of a substrate surface using a polishing member (not shown) that has a surface area that is less than the surface area of a to-be-polished substrate. LSP modules 330 are often used after a substrate has been polished within a polishing module to touch up, e.g., remove additional material, from a relatively small portion of the substrate. In some embodiments one or more LSP modules 330 may be included within the second portion 305 in place of one of the polishing modules 200*a*, 200*b*.

In other embodiments the one or more LSP modules 330 may be disposed in any other desired arrangement within the modular polishing systems set forth herein. For example, one or more LSP modules 330 may be disposed between the first portion 320 and the second portion 305, between adjacently disposed polishing modules 200*a-i* in any of the arrangements described herein, and/or proximate to an end of any of the second portions described herein, the end of the respective second portion being distal from the first portion. In some embodiments, the modular polishing systems may include one or more buffing modules (not shown) which may be disposed in any of the arrangements described above for the LSP module 330. In some embodiments, the first portion 320 features at least two post-CMP cleaning systems 332 which may be disposed on opposite sides of the second robot 326.

A post-CMP cleaning system facilitates removal of residual polishing fluids and polishing byproducts from the substrate 280 and may include any one or combination of brush or spray boxes 334 and a drying unit 336. The first and second robots 324, 326 are used in combination to transfer substrates 280 between the second portion 305 and the first portion 320 including between the various modules, stations, and systems thereof. For example, here, the second robot 326 is at least used to transfer substrates to and from the carrier loading stations 240 of the respective polishing modules 200*a*, 200*b* and/or therebetween.

In embodiments herein, operation of the modular polishing system 300 is directed by a system controller (not shown) that includes a programmable central processing unit (CPU) which is operable with a memory (e.g., non-volatile memory) and support circuits. The support circuits are conventionally coupled to the CPU and comprise cache, clock circuits, input/output subsystems, power supplies, and the like, and combinations thereof coupled to the various components of the modular polishing system 300, to facilitate control thereof. The CPU is one of any form of general purpose computer processor used in an industrial setting, such as a programmable logic controller (PLC), for controlling various components and sub-processors of the processing system. The memory, coupled to the CPU, is non-transitory and is typically one or more of readily available memories such as random access memory (RAM), read only memory (ROM), floppy disk drive, hard disk, or any other form of digital storage, local or remote.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the disclosure should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A multiple disk pad conditioner for conditioning a polishing pad, comprising:
- a conditioning arm; and
- a plurality of conditioning head bases attached to the conditioning arm, wherein:
  - each conditioning head base comprises a pivot arm;
  - each pivot arm comprises a plurality of conditioning heads;
  - each of the plurality of conditioning heads has a conditioning disk affixed thereto,
  - each of the plurality of conditioning head bases comprise a rotational axis, and
  - each of the rotational axes are disposed a distance apart in a first direction that extends along a length of the conditioning arm.

2. The multiple disk pad conditioner of claim 1, wherein the conditioning arm is affixed to a rotatable base able to sweep a first end of the conditioning arm across the polishing pad.

3. The multiple disk pad conditioner of claim 1, wherein the plurality of conditioning heads are configured to rotate at the same revolutions-per-minute (RPM) about their respective rotational axis during a conditioning process.

4. The multiple disk pad conditioner of claim 1, wherein the plurality of conditioning heads are configured to rotate at different revolutions-per-minute (RPM) about their respective rotational axis during a pad conditioning process.

5. The multiple disk pad conditioner of claim 1, further comprising one or more down-force actuators to maintain a uniform pressure between the plurality of conditioning heads and the polishing pad.

6. The multiple disk pad conditioner of claim 1, further comprising one or more down-force actuators to independently regulate pressure between each of the plurality of conditioning heads and the polishing pad.

7. The multiple disk pad conditioner of claim 1, wherein the multiple disk pad conditioner is disposed within a polishing station that comprises a cleaning station for cleaning the plurality of conditioning heads.

8. The multiple disk pad conditioner of claim 1, wherein
- each of the conditioning disks comprise a support plate, a flexible member, and a flexible backing element,
- the flexible backing element comprises abrasive regions for conditioning the polishing pad, and
- the flexible member is disposed between the support plate and the flexible backing element.

9. The multiple disk pad conditioner of claim 8, wherein the abrasive regions comprise diamond particles.

10. The multiple disk pad conditioner of claim 8, wherein the abrasive regions comprise silicon carbide.

11. The multiple disk pad conditioner of claim 8,
- wherein the flexible backing element of each of the conditioning disks is configured to cause substantially uniform contact between abrasive particles and the polishing pad while the multiple pad conditioner is conditioning the polishing pad.

12. The multiple disk pad conditioner of claim 11, wherein the support plate is comprised of a metal or a ceramic material.

13. The multiple disk pad conditioner of claim 11, wherein the flexible member is comprised of an elastomeric material.

14. The multiple disk pad conditioner of claim 11, wherein the flexible backing member is comprised of an elastomeric material or a metal plate.

15. A method of conditioning a polishing pad, comprising:
- conditioning the polishing pad using a multiple disk pad conditioner, wherein:
  - the multiple disk pad conditioner comprises a conditioning arm for carrying a plurality of pad conditioning head bases,
  - each conditioning head base comprising a pivot arm,
  - each pivot arm comprising a plurality of pad conditioning heads
  - each of the plurality of conditioning heads has a conditioning disk affixed thereto,
  - each of the plurality of conditioning head bases comprise a rotational axis,
  - each of the rotational axes is disposed a distance apart in a first direction that extends along a length of the conditioning arm, and
  - conditioning the polishing pad comprises urging the plurality of pad conditioning heads against a surface of a polishing pad.

16. The method of claim 15, wherein conditioning the polishing pad further comprises:
- rotating the polishing pad at a first revolutions-per-minute (RPM); and
- rotating each of the conditioning disks at the first revolutions-per-minute (RPM).

17. The method of claim 15, wherein the conditioning the polishing pad further comprises rotating at least one of the conditioning disks at different RPMs about their respective rotational axis during a conditioning process.

18. The method of claim 15, wherein conditioning the polishing pad further comprises maintaining a constant pressure between the conditioning disks and the polishing pad while urging the plurality of pad conditioning heads against the surface of a polishing pad.

19. The method of claim 15, wherein conditioning the polishing pad further comprises maintaining independent pressure control between at least one of the conditioning disks and the polishing pad.

20. A polishing system, comprising:
- a plurality of polishing modules, each comprising:
  - a carrier support module comprising a carrier platform, and one or more carrier assemblies comprising one or more corresponding carrier heads which are suspended from the carrier platform;
  - a carrier loading station for transferring substrates to and from the one or more carrier heads;
  - a polishing station comprising a polishing platen, wherein the carrier support module is positioned to move the one or more carrier assemblies between a substrate polishing position disposed above the polishing platen and a substrate transfer position disposed above the carrier loading station; and
  - a multiple disk pad conditioner having a plurality of conditioning head bases attached to a conditioning arm and disposed a distance apart in a first direction that extends along a length of the conditioning arm; wherein:

each conditioning head base comprises a pivot arm;

each pivot arm comprises a plurality of conditioning heads; and each of the plurality of conditioning heads has a conditioning disk affixed thereto.

* * * * *